United States Patent [19]

Schaefer et al.

[11] Patent Number: 4,660,777

[45] **Date of Patent: * Apr. 28, 1987**

[54] APPARATUS FOR MANUFACTURING FLAKES

[75] Inventors: Karl Schaefer, Lechbruck am See; Heinz Stein, Unna-Hemmerde, both of Fed. Rep. of Germany

[73] Assignee: Inter-wood Maschinen GmbH & Co. KG, Lechbruck am See, Fed. Rep. of Germany

[ * ] Notice: The portion of the term of this patent subsequent to Jun. 10, 2003 has been disclaimed.

[21] Appl. No.: 590,081

[22] Filed: Mar. 15, 1984

[30] Foreign Application Priority Data

Mar. 17, 1983 [DE] Fed. Rep. of Germany ..... 3309517

[51] Int. Cl.[4] ..... B02C 13/09

[52] U.S. Cl. ..... 241/88; 241/89.2; 241/188 R; 241/189 R; 241/240; 241/241

[58] Field of Search ..... 241/223, 101.2, 30, 241/89.3, 95, 241, 242, 243, 285 R, 299, 285 A, 291, 293, 294, 86.1, 87.1, 89.1, 89.2, 237, 238, 88, 188 R, 189 R, 240, 301; 30/276

[56] References Cited

U.S. PATENT DOCUMENTS

| | | | |
|---|---|---|---|
| 2,216,612 | 10/1940 | Dimm et al. | 241/237 X |
| 2,690,777 | 10/1954 | Korber et al. | 241/223 X |
| 3,866,643 | 2/1975 | Schaefer . | |
| 4,593,862 | 6/1986 | Schaefer et al. | 241/89.2 X |

FOREIGN PATENT DOCUMENTS

| | | |
|---|---|---|
| 1086876 | 8/1960 | Fed. Rep. of Germany . |
| 2420189 | 10/1975 | Fed. Rep. of Germany . |
| 1653098 | 5/1976 | Fed. Rep. of Germany . |
| 2628773 | 4/1978 | Fed. Rep. of Germany . |
| 2639123 | 11/1979 | Fed. Rep. of Germany . |
| 3228852 | 4/1983 | Fed. Rep. of Germany . |

*Primary Examiner*—Mark Rosenbaum

*Attorney, Agent, or Firm*—Flynn, Thiel, Boutell & Tanis

[57] ABSTRACT

Method for the manufacture of flakes from chips and apparatus for carrying out the method. The worn, in use, blade portions of a strip-steel knife are exchanged continuously or periodically with sharp strip-steel knives during the flake manufacturing operation. The feed of the strip-steel knives is preferably time-dependent and/or dependent on the energy consumption of the apparatus. Disposed longitudinally of the knife-ring are one or several magazines for supplying or/and receiving the strip-steel knives.

7 Claims, 10 Drawing Figures

APPARATUS FOR MANUFACTURING FLAKES

FIELD OF THE INVENTION

Method for the manufacture of flakes from chips (e.g; chips of fibrous material such as wood chips) and an apparatus for carrying out the method.

BACKGROUND OF THE INVENTION

According to German AS No. 1 086 876, a knife-ring cutter of the type for disintegrating wood chips has become known. A stationary, cylindrical knife-ring is tipped hereby on its inner periphery at even distances with exchangeable regrindable knives. A chip feeder with secantially arranged moving arms and adjustable striking bars (counterknives) rotates inside the knife-ring. Through the action of the air stream which is sucked in by the air blades and of centrifugal force, the chips are moved in a direction substantially parallel to the fibers therein in front of the knife blades, in such a manner that they are divided into thin flakes along the direction of the fibers therein. Known furthermore are knife-ring cutters with a stationary, conical knife-ring (compare German Pat. No. 16 53 098 and German OS No. 24 20 189).

Finally German Pat. No. 26 39 123 suggests a method and a corresponding apparatus in which the chips, which along their fiber direction are at least twice as long as the length of the flakes which are supposed to be manufactured therefrom, are disintegrated into flakes, the chip length of which is defined for which strip knives with additional chipping edges or strip knives which are tipped with chipping noses are supposed to be used.

In the above-mentioned apparati, knife blades and rotating counterknives can be arranged parallel to the axis of rotation or at an angle thereto. In the case of an angular arrangement, the cutting knives apply a slanted cut, which is also identified as a diagonal cut.

The mentioned apparati (knife-ring cutters) have in common that their knives at the end of their cutting edge life (i.e. when dull) must be dismounted, reground and thereafter again installed, all of which is time consuming. Even if corresponding with German AS No. 26 28 773 at the end of an edge life, the complete knife-ring is dismounted and is replaced with a knife-ring with sharp knives, this still leaves it necessary to exchange, outside of the apparatus, all dull knives with sharpened knives.

As blade dulling progresses, energy consumption of the apparatus increases, while at the same time the chip cutting flake quality drops. Thus, there have been many efforts to improve the chip cutting quality. Knife-ring cutters, in which cutting knife and counterknife are arranged at a certain diagonal-cut angle to one enother to achieve a slicing cut which is advantageous for the chip quality, produce at the start of an edge life considerably better flakes than knife-ring cutters in which cutting knife and counterknife are axially parallel. Said diagonal cut, however, causes the packing density of the chips to increase toward the trailing knife end. The consequence is that the knives become considerably more quickly dull in this area. In the case of knife-ring cutters with axially parallel cutting knives and counterknives, the chip quality is not so high at the start of cutting, but the load on the knives is more uniform and wear is not so quick. However, the influence on the chip quality and energy consumption due to more frequent knife exchange has narrow limits, not only for reasons of cost, but also because the percentage portion of chips which are too thick and are torn and are produced at the start of an edge life with "overly sharp" knives increases to the same degree as the running time of the knife is shortened. In addition, it is often not permissible in industrial practice to simply switch off a knife-ring cutter with dulled knives. During a chip shortage, which occurs particularly often during the winter, cutting must be continued without consideration for the chip quality and energy consumption because otherwise the entire production would come to a halt. However, especially during the cold time of the year, the knives must be exchanged considerably more often, because strongly frozen chips which have mixed with them sand or frozen-on stones reduce the edge life of a set of knives often to a few minutes, which is disadvantageous for chip production.

Thus the basic purpose of the invention is to provide a method with the help of which, independent from the condition of the supplied chips, flakes of an always constant quality and homogeneity are produced, in that the factors "chip quality" and "energy consumption" are brought preselectably into a relation which corresponds with the economical and technological demands. The apparatus for carrying out the method is intended to be constructed to assure uninterrupted operation over a time period which is as long as possible.

This purpose is attained by the invention with a method, in which blade portions of a long strip-steel knife, which blade portions are in use, have over the full operating time always the same medium sharpness. For limiting the chip lengths, the blades of the strip-steel knives can be provided with integrated chipping edges, for example corresponding with those shown in U.S. Pat. No. 3,866,643 or German OS No. 32 28 852. The apparatus which is utilized for carrying out the method uses a chip cutter of the general known kind having a stationary, cylindrical knife-ring and therein installed, a rotating chip conveying mechanism for fiber-parallel chip forced feed, which conveyor mechanism is tipped with counterknives preferably arranged at a diagonal-cut angle with respect to the strip-steel knives and therefore with correspondingly concave-shaped or spiral-shaped counter-knives. The knife-ring is provided at symmetrical distances on its inner periphery with knife-clamping devices. Each knife clamping device includes clamping plate. Each clamping plate is tightened preferably by a conventional center clamping (tightening) means. Strip-steel knives which are ground on one side or on both sides are advanced, either continuously for periodically on a timed basis, between said clamping plates. The length of one strip-steel knife corresponds at least to the single, but preferably to a multiple of the cutting blade portion actually in use. The advance (feed) of the strip-steel knives can be made easier by the knives having on both sides of their longitudinal axis pressed-in recesses, into which enters a corresponding feed mechanism. In addition, a corresponding lubricant can be applied onto the strip steel. The strip-steel knives can at a suitable length also be pulled through between their clamping plates. Each strip-steel knife can be of great length (in effect of endless length) and unwound from a roller into position between its clamping plates from which the dulled portion of the knife is wound onto a further roller on the output side of the clamping plates. Alternatively each strip-steel knife can be fed to its clamping plates in shorter individual lengths which correspond with a part or a single or multiple length of the blade section in use. In a preferred embodiment such blade lengths are stored stacked in a magazine, from where they are fed by a corresponding feed-in or pull-through mechanism to a respective pair of clamping plates. Alternatively a universal (common or central) magazine can be arranged movably such that all strip-steel knives can be fed successively to successive pairs of clamping plates. Finally, in the case of a stationary universal magazine, the knife-ring can be supported rotatably in a conventional manner in order to make possible in this manner the loading of the knife-ring with new strip-steel knives.

In order to exactly maintain the desired knife protrusion it is possible for example to provide strip-steel turning knives with a conventional through-going centering groove, into which engage spring, which are received in one of the two clamping plates. In strip-steel turning knives according to German OS No. 32 28 852 it is also possible to utilize the rearward chipping edges, which are not in engagement with the chips, as stop surfaces. In the case of strip-steel knives ground sharp only on the front edge the back edge of the knife can be used for a stop surface.

Corresponding with the inventive method, the continuous or timed (periodic) advancing of the strip-steel knives occurs dependent on time or dependent on apparatus energy consumption level. In the case of an timed feed, the central clamping means for all knives is designed to provide two different clamping stages force levels, as follows. A weaker clamping stage 1 makes the timed infeed or pull-through of the strip-steel knives easier. Immediately after the end of one cycle, clamping stage 2 is switched on, which applies a higher contact pressure. In the preferred embodiment of the inventive apparatus with knife arrangement for diagonal cut, knife infeed occurs from the machine side where the chips to be cut have the greatest packing density, so that the respectively sharper blade section lies always in the zone of the greatest blade wear rate (stress). In the case of axially arranged strip-steel knives, and counterknives which are arranged thereto for diagonal cut, the cutting edge of the counterknife is constructed such that, due to its concave or spiral-shaped construction it has over its full length always the same distance from the cutting edges of the strip-steel knives.

BRIEF DESCRIPTION OF THE DRAWINGS

The invention will be discussed in greater detail hereinafter in connection with the drawings, in which.

DETAILED DESCRIPTION

Figure 1:
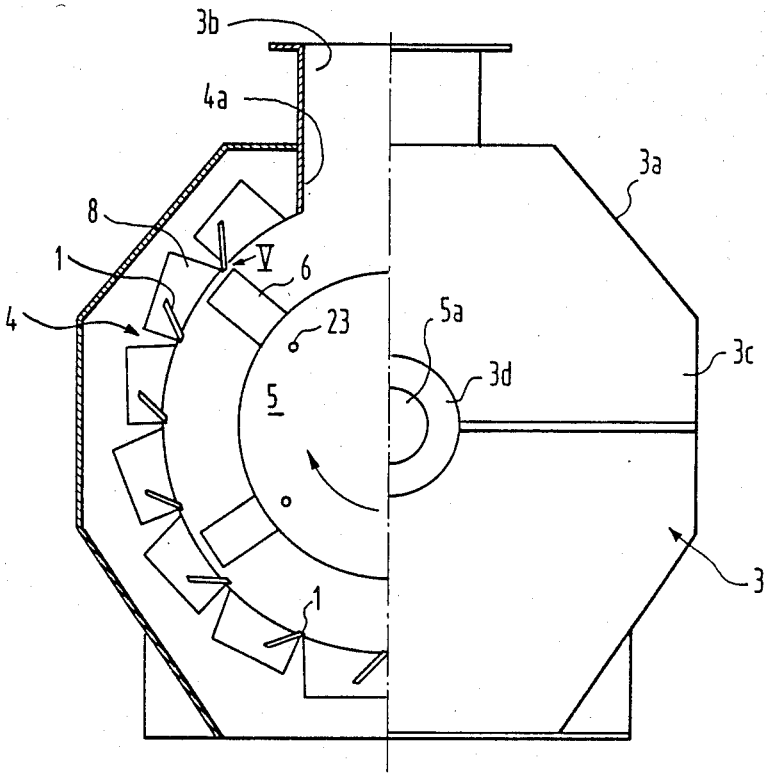
FIG. 1 is a view, partly in end elevation and partly in cross-section, of an apparatus (chip flaker) embodying the invention, taken perpendicular to the axis of rotation of the chip conveying mechanism thereof.
Figure 5:
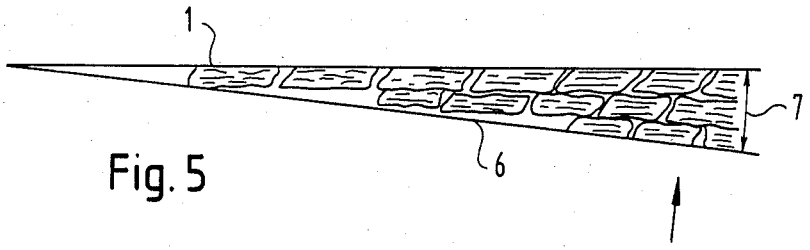
FIG. 5 is a schematic illustration, substantially as taken in the direction of arrow V in FIG. 1, of the diagonal cut arrangement of knife and concave-shaped counter-knife to make clear the different loading of chips at different zones along the length of the blade.

The apparatus 3 (FIG. 1) is a chip cutter of the kind having a hollow housing 3*a* supporting therein a stationary, hollow cylindrical knife-ring 4 surrounding a chip conveying mechanism 5 rotatably supported at its ends 5*a* within the knife-ring 4 by conventional bearings 3*d* in the end walls 3*c* of the housing 3. Aligned inlet ports 3*b* and 4*a* respectively in the top of housing 3 and knife-ring 4 admit wood chips to the flaked, into the hollow interior of the knife-ring 4 and into engagement with the chip conveying mechanism 5. The chip conveying mechanism 5 is tipped with concave or spiral-shaped counter-knives 6 which are movably suspended on pivot axes 23 on the chip conveying mechanism 5. Strip-steel knives 1 are mounted on the knive-ring 4 as hereafter discussed. The concave-shaped counterknives 6 are located with respect to the strip-steel knives 1 at a diagonal-cut angle 7 (FIG. 5).

Figure 6:
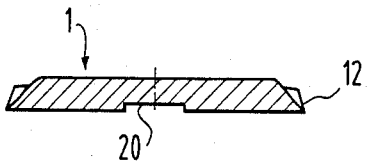
Fig. 6 PRIOR ART
FIG. 6 is the cross-sectional view of a strip-steel turning knife with scratching means according to U.S. Pat. No. 3,866,643.
Figure 7:
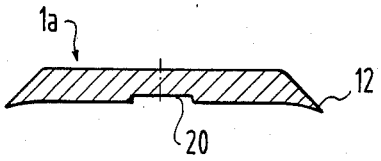
Fig. 7 PRIOR ART
FIG. 7 is the cross-sectional view of a strip-steel turning knife with scratching means according to German OS No. 32 28 852.

The knife-ring 4 is formed by a circumferential array of longitudinally extended knife clamping devices 8. The knive-ring 4 is fixed by any convenient means not shown within the housing 3 (for example to the opposed end walls 3*a* of the housing 3). The knife-ring 4 thus has spaced along its periphery, at symmetrical distances, a plurality of the knife-clamping devices 8. The knife-clamping devices each receive a steel-strip turning knife 1 having a centeringgrove 20 (FIGS. 6 and 7). Springs 21 are received exchangeably in a corresponding groove in the knife-ring 4. Each knife clamping device 8 comprises a clamping plate 8*a* which is rotatably fixed with a bolt 8*b* to a ring 8*c*, which is pivotably connected to the end walls of housing 3 (FIGS. 2 and 3).

Figure 2:
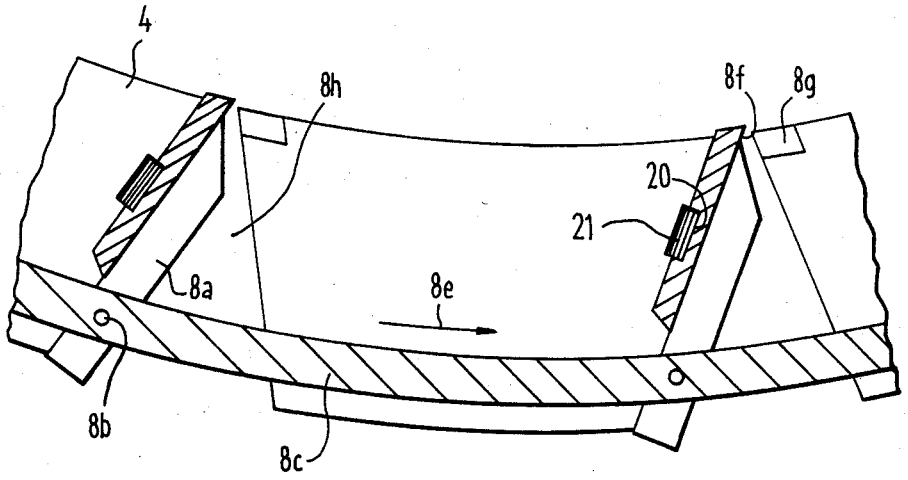
FIG. 2 is an enlarged cross-sectional view of a knife-ring segment of the FIG. 1 apparatus, taken perpendicular to the axis of rotation of the chip conveying mechanism, and showing a knife-clamping device.

In FIG. 2 clamping plates 8*a* are in its clamping position. By movement of ring 8*c* in the direction of arrow 8*e* clamping plates 8*a* are moved for replacement of knives 1. In this way the tips 8*f* of the clamping plates 8*a* remain in contact with knives 1. Thus, small particles and dust cannot enter into the clamping system during replacement of the knives 1. 8*h* is a flake evacuation chamber provided within knife-ring 4. A gap width of approximately 0.6–0.8 mm. exists between clamping plate 8*a* and an opposing wear lip 8*g* which is fixed on the knife-ring 4, said gap width being selected for the passing therethrough of the cut flakes.

Figure 8:
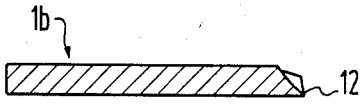
Fig. 8 PRIOR ART
FIG. 8 is the cross-sectional view of a strip-steel turning knife according to U.S. Pat. No. 3,866,643 in a one-side ground design.

The strip-steel knives 1 can be provided with scratching means 12 (FIGS. 6–8).

Figure 3:
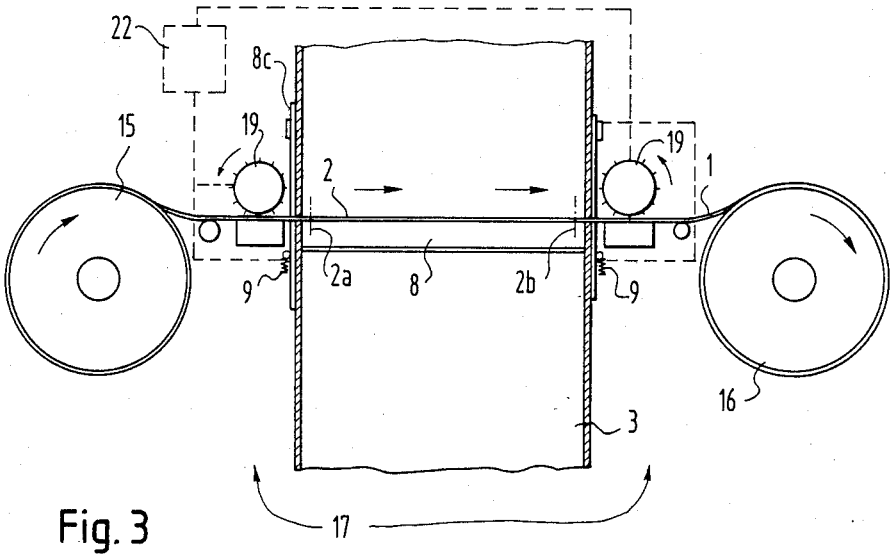
FIG. 3 is a fragmentary, partially broken view of the apparatus of FIG. 1, with the plane of the paper parallel to the axis of rotation of the chip conveying mechanism, showing a knife feeding mechanism with only one strip-steel roller arranged on each of the input side and the output side.
Figure 4:
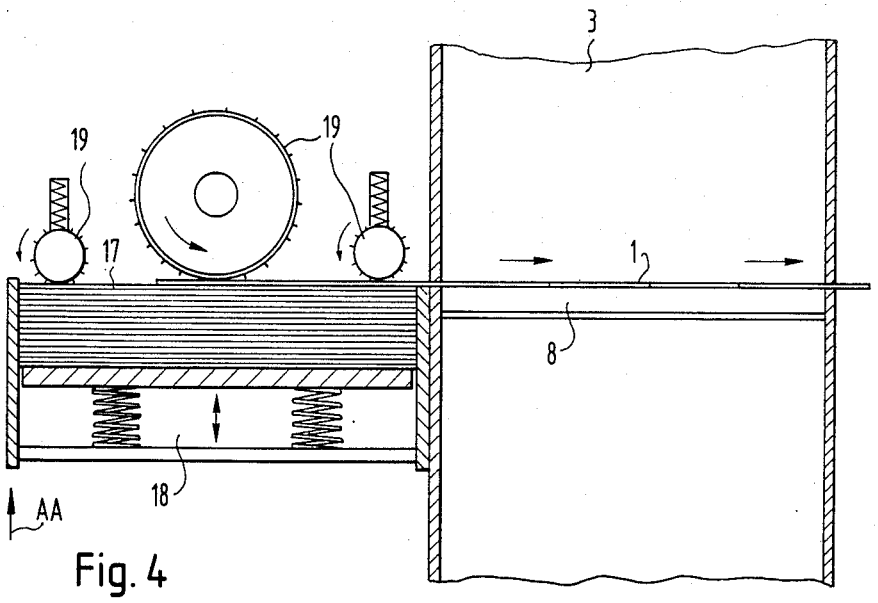
FIG. 4 is a fragmentary, partially broken view of the apparatus of FIG. 1, with the plane of the paper parallel to the axis of rotation of the chip conveying mechanism, showing a knife magazine which is installable on either the input side or on the output side of the chip cutter and having a feed-in or pull-through mechanism.
Figure 9:
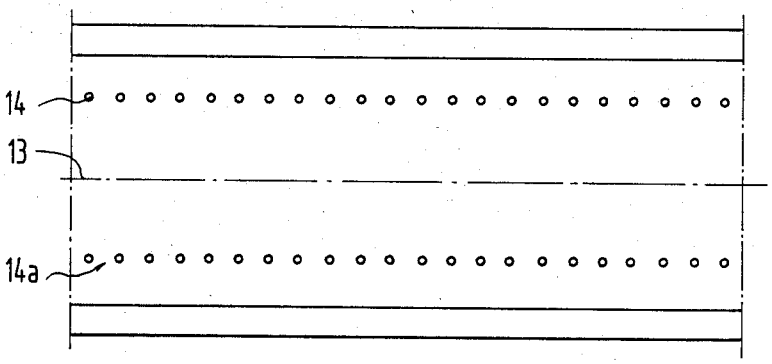
FIG. 9 is the top view of a strip-steel knife with pressed-in recesses or performations.
Figure 10:
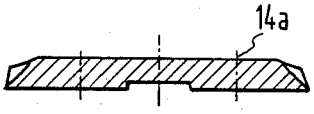
FIG. 10 is a cross-sectional view of a strip-steel knife of FIG. 9.

The knives 1 furthermore receive on both sides of their longitudinal axis 13 (FIG. 9) recesses 14 or perforations 14*a*, into which engages protrusions on a correspondingly constructed feed-in or pull-through mechanism 19 useable in the alternative knife feeding mechanisms of FIGS. 3 and 4. In the embodiment shown, the mechanisms 19 each comprise a drive roller 19 rotatably drivable by suitable motor means not shown.

In FIG. 3, for example, a much elongated (multiple length) strip-steel knife 1 can be fed from a strip-steel roller 15 by its feed-in or pull-through mechanism 19 and can be wound onto the strip-steel roller 16 on the output side. In this position an intermediate length portion 2 (extending from 2*a* to 2*b*) is clamped between the clamping plate 8*a* and ring 4 for use. By winding a dulled length portion of the elongate strip-steel knife onto roller 16 the adjacent sharp length portion unwound from roller 15 replaces it in the corresponding clamping device 8, to quickly and easily maintain the desired sharpness of cutting edge of the knife 1 acting on the chips in the housing 3. Adequate room for the plurality of rollers 15 and 16 is achieved by positioning said rollers 15 and 16 with different distances from housing 3.

Alternatively, as in FIG. 4, strip-steel knives 1 can be fed to their respective clamping plates 8*a* and 8*b* in substantially shorter lengths, which correspond to the single or small multiple of the blade length actually in use. In a preferred embodiment, several such shorter blade lengths 2 are stored in a stack (here spring loaded upward) in a magazine 17, from where they are fed by a suitable feed-in and/or pull-through mechanism 19 to the respective knife-clamping device 8. Furthermore, a common central magazine 18 can (as here only schematically indicated in the drawings by the arrow AA) be mounted for movement circumferentially of the housing 3 and knife-ring therein to feed individual strip-steel knives 1 one after the other to successive respective pairs of clamping plates 8*a* and 8*b* in the housing 3. On the right side of the housing 3*a* further magazine (not shown) is provided for the dull knives, for instance a container.

For the timed loading of the strip-steel knives 1, a central clamping means 10 (FIG. 3) is provided to permit selection between two different clamping force levels applied to the knife 1. In the embodiment shown, the strip-steel knives 1 are clamped between the ring 4 and clamping plates 8*a* by the conventional central pivotable ring 8*c* operated mechanically or hydraulically by means 9. The pivotable ring 8*c* is mounted for concentric rotation about the longitudinal axis of the knife-ring 4. However, instead of pivotable ring 8*c* a number of further clamping means are known, which can instead be used. Such central clamping means are not the subject matter of the invention.

Blade-part sections 2*a* or 2*b* (FIG. 3) are, when mounted for a diagonal cut according to FIG. 5, tipped differently with chips due to centrifugal forces acting on chips in rotation.

The strip-steel knife 1 (FIG. 6) is constructed as a turning knife, the chipping edge means 12 of which project from the free surface of the knife 1. The alternative strip-steel knife 1*a* (FIG. 7) is constructed as a turning knife, the chipping edge means 12 of which project from the knife front. The alternative strip-steel knife 1*b* (FIG. 8) is a one-side ground knife with chipping edge means 12, which project from the free surface of the knife.

The particular advantages of the inventive method can be seen in that inexpensive wood assortments can be cut for the first time to flakes of always constant quality and homogeneity at a preselectable maximum chip length, by bringing the factors "chip quality" and "energy consumption" inventively into a constant relation which meets the economical and technological demands. This is made possible by the inventive apparatus 3, which is provided with strip-steel knives of practically any length which are continually or periodically advanced lengthwise through the apparatus. With this invention, the prior necessary knife exchange, which resulted in a corresponding production loss, no longer takes place. In the case of damage to knives 1 due to contact with foreign objects, an energy-consumption-dependent control of the feed-in or pull-through mechanism 19 (FIG. 3 or 4) could be used to accelerate the continuous or timed feeding of all strip-steel knives 1 so that, within the shortest period of time, all damaged blade sections 2 would be removed from the cutting area.

In FIGS. 3 and 4 drive rollers 19 for feeding a sharp knife or knife portion into position in clamping device 8 can be actuated by means 22 which also actuate means 9 for operating pivotable ring 8*c*. Means 22 can be an ammeter or a timer.

In contrast to regrinding knives with a blade rectilinearity of ±0.1 mm., which the chip woodworking plant can achieve at best, the present invention enables use of strip-steel knives 1 which are tipped with blades on one or both sides and which can be manufactured on industrial grinding units with a blade rectilinearity within a few one-hundredths mm. Thus, a considerably higher percentage of the chips produced with strip-steel knives 1 of the present invention lie in the desired thickness range, which has the result that wood wastage is reduced detectably.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A disintegrator apparatus, comprising a stationary cylindrical knife-ring carrying knives with inward directed blades, a rotating conveying mechanism within said knife-ring and having striking elements which throw material to be particularted against the blades of the knives, said conveying mechanism being rotatable about a rotational axis, knife-clamping devices arranged at symmetrical distances on the inner periphery of the knife-ring for circumferentially positioning of the knives in the knife-ring, and at least one magazine located outside one axial end of said knife-ring for storing knives therein, and means associated with said magazine for moving a knife in parallel with said rotational axis through said knife-ring and therewith for replacing a worn knife with a sharp one during operation of the apparatus.

2. Apparatus according to claim 1, wherein the knife has surface interruptions on both sides of its longitudinal axis, said moving means including drive means engageable with said interruptions for advancing said knife axially of said knife-ring in a positive manner.

3. Apparatus according to claim 1, wherein the knives at one location on said knife-ring are formed by a continuous strip of steel with a cutting edge extending longitudinally along one side of the strip.

4. Apparatus according to claim 3, wherein the magazine has one roller each on the input side and on the output side of the knife-ring, from which input side roller and onto which output side roller respectively the knife strip is wound off and is wound respectively.

5. Apparatus according to claim 1, wherein plural knives are stacked at the input side of said knife-ring in the magazine, and wherein said knife moving means includes means for axially feeding the knives to the axially adjacent clamping device.

6. Apparatus according to claim 5, wherein the magazine is arranged movably in order to successively feed knives to two clamping devices.

7. Apparatus according to claim 5, wherein the magazine and knife-ring are supported for relative rotation.

* * * * *

UNITED STATES PATENT AND TRADEMARK OFFICE

CERTIFICATE OF CORRECTION

PATENT NO. : 4 660 777

DATED : April 28, 1987

INVENTOR(S) : Carl SCHAEFER et al

It is certified that error appears in the above-identified patent and that said Letters Patent is hereby corrected as shown below:

Column 6, Line 52; Change "particularted" to ---particulated---.

Signed and Sealed this

Seventeenth Day of November, 1987

*Attest:*

DONALD J. QUIGG

*Attesting Officer*

*Commissioner of Patents and Trademarks*